US006475106B1

(12) United States Patent
Green et al.

(10) Patent No.: US 6,475,106 B1
(45) Date of Patent: Nov. 5, 2002

(54) GOLF BALL WITH GROOVED DIMPLES

(75) Inventors: Stephen M. Green, Syracuse, NY (US); Gary Tavares, Banks, OR (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 77 days.

(21) Appl. No.: 09/702,227

(22) Filed: Oct. 31, 2000

(51) Int. Cl.[7] ..... A63B 37/12; A63B 37/14
(52) U.S. Cl. ..... 473/383; 473/378
(58) Field of Search ..... 473/378–384

(56) References Cited

U.S. PATENT DOCUMENTS

| | | | | |
|---|---|---|---|---|
| 44,408 | A | | 11/1864 | Martin et al. |
| 47,159 | A | | 1/1865 | Kempshall |
| 2,861,810 | A | | 11/1958 | Veatch |
| 4,729,861 | A | | 3/1988 | Lynch et al. |
| 4,836,552 | A | | 6/1989 | Puckett et al. |
| 4,840,381 | A | | 6/1989 | Ihara et al. |
| 4,936,587 | A | | 6/1990 | Lynch et al. |
| D319,481 | S | | 8/1991 | Shaw |
| 5,080,367 | A | | 1/1992 | Lynch et al. |
| 5,338,039 | A | | 8/1994 | Oka et al. |
| D355,943 | S | | 2/1995 | Cadorniga |
| 5,470,076 | A | | 11/1995 | Cadorniga |
| 5,503,398 | A | * | 4/1996 | Lu ..... 473/384 |
| 5,536,013 | A | | 7/1996 | Pocklington |
| 5,776,013 | A | | 7/1998 | Yokota et al. |
| 5,857,924 | A | | 1/1999 | Miyagawa et al. |
| 5,879,245 | A | | 3/1999 | Hwang |
| 6,139,448 | A | * | 10/2000 | Sullivan ..... 473/377 |
| 6,150,470 | A | * | 11/2000 | Sullivan ..... 273/DIG. 22 |
| 6,162,136 | A | * | 12/2000 | Aoyama ..... 473/383 |
| 6,176,793 | B1 | * | 1/2001 | Sullivan et al. ..... 473/351 |
| 6,315,686 | B1 | * | 11/2001 | Barfield ..... 473/378 |

FOREIGN PATENT DOCUMENTS

| | | | | |
|---|---|---|---|---|
| EP | 536725 A1 | * | 4/1993 | ..... A63B/37/14 |
| GB | 2215621 A | * | 9/1989 | ..... A63B/37/14 |

* cited by examiner

*Primary Examiner*—Paul T. Sewell
*Assistant Examiner*—Alvin A. Hunter

(57) ABSTRACT

A new configuration for dimples on the surface of a golf ball is characterized by a plurality of grooves in the concave surface of the dimple. The grooves are concentrically arranged relative to the geometric configuration defined at the intersection with the spherical surface. The depth of the grooves increases from an outermost groove to an innermost groove. The grooves within at least some of the dimples on the surface of the ball improve the aerodynamic efficiency of the dimples to reduce drag and increase the distance the ball will travel.

12 Claims, 2 Drawing Sheets

GOLF BALL WITH GROOVED DIMPLES

BACKGROUND OF THE INVENTION

The present invention relates to a new configuration for the dimples on a golf ball surface which improve the flight characteristics of the ball.

According to the United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

Drag on a golf ball is also reduced by forming a plurality of dimples, often circular, in the outer surface of the ball. The dimples serve to reduce the pressure differential between the front and rear of the ball as it travels through the air.

BRIEF DESCRIPTION OF THE PRIOR ART

Numerous dimple configurations for use on golf balls are well-known in the patented prior art, including contoured dimples. For example, the Oka et al U.S. Pat. No. 5,338,039 discloses a golf ball having a plurality of polygonal dimples which have a double slope in section so that the dimples appear to have an inner configuration matching that of the polygon. The Cadorniga U.S. Pat. No. 5,470,076 discloses a golf ball having a plurality of dimples with major and minor portions in the manner of a dimple within a dimple. The major portion has a first spherical span and the minor portion has a second spherical span less than the first span, with the minor portion being arranged within the major portion. Both the Oka et al and Cadorniga dimple designs are to improve the flight and aerodynamic performance of the golf ball.

The present invention was developed in order to improve the aerodynamic efficiency of the dimples on a golf ball so that the ball will travel a straighter and a greater distance than conventional golf balls having circular dimples.

SUMMARY OF THE INVENTION

Accordingly, it is a primary object of the present invention to provide a golf ball having a spherical surface including a plurality of dimples arranged in the surface. At least one of the dimples includes an outer edge defining a geometric configuration at the intersection with the spherical surface and a concavity in the ball surface. The concavity has a bottom surface containing a plurality of grooves, the grooves being concentrically arranged relative to the geometric configuration. The depth of the grooves relative to the outer edge increases from an outermost groove to an innermost groove.

According to a further object of the invention, the spacing between the grooves is equal. The grooves may have either a stepped or V-shaped configuration and the dimple may be circular or oval.

BRIEF DESCRIPTION OF THE FIGURES

These and other objects according to the invention will become apparent from a study of the following specification when viewed in the light of the accompanying drawing, in which.

DETAILED DESCRIPTION

Figure 1:
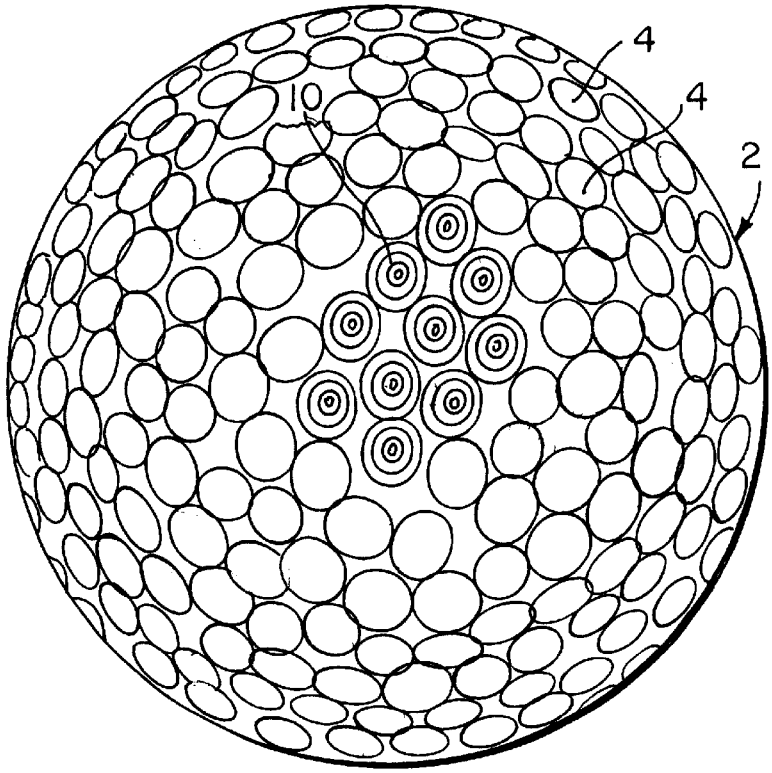
FIG. 1 is plan view of a golf ball including a plurality of grooved circular dimples according to the invention.
Figure 2:
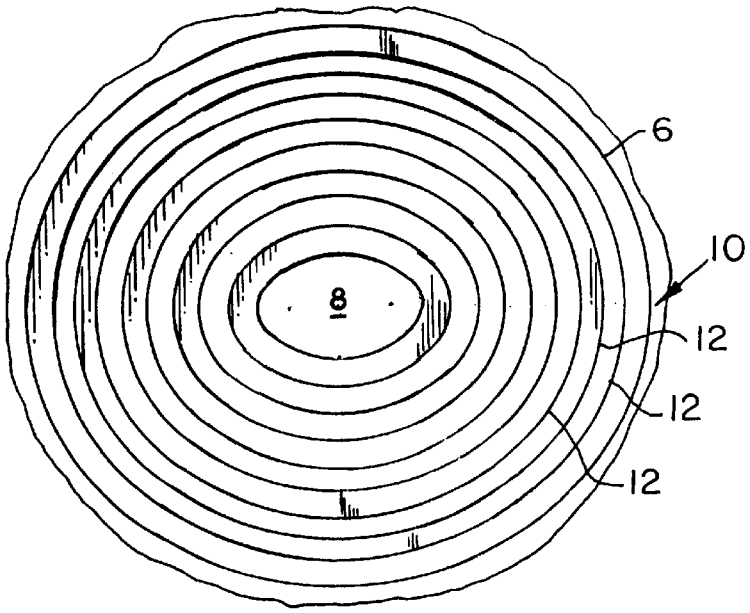
FIG. 2 is a plan view of a grooved dimple according to the invention.
Figure 3:
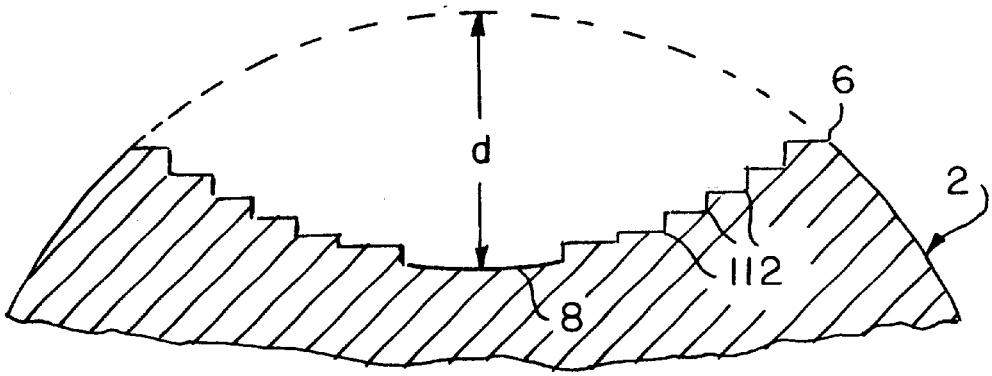
FIGS. 3 and 4 are sectional views, respectively, of a grooved dimple according to first and second embodiments of the invention, respectively.

In FIG. 1, there is shown a golf ball 2 having a spherical surface which contains a plurality of circular dimples 4, the circle being defined where the dimple intersects with the surface of the ball. The dimples may all be of the same diameter, or different diameter dimples may be provided. In addition, some or all of the dimples may have an oval configuration at the intersection with the golf ball surface as shown in FIG. 2. Each dimple includes an outer edge 6 having a circular or oval geometric configuration and a concave bottom surface 8 in the golf ball. As shown in FIG. 3, the dimples have a depth d extending from the surface of the golf ball (shown in phantom) to the lowermost portion of the concavity.

At least some of the dimples 10 in the golf ball surface contain a plurality of grooves 12 which are concentrically arranged relative to the geometric configuration of the outer edge. In a preferred embodiment, the spacing between the grooves is equal as shown in FIG. 2.

Figure 4:
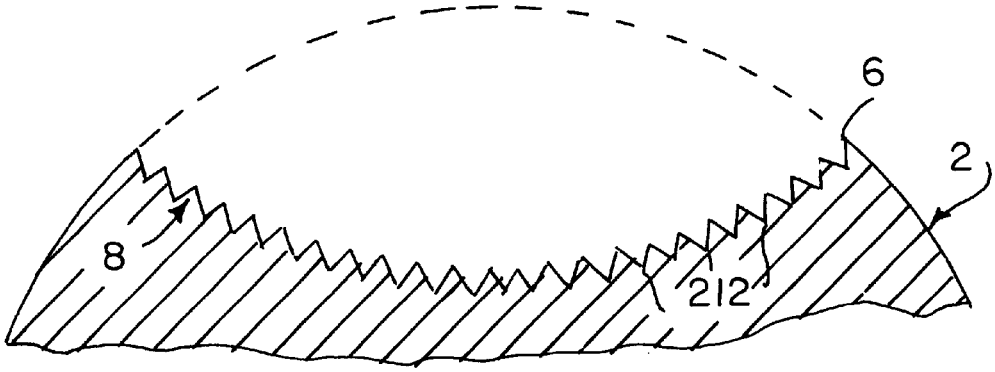

The grooves may have any desired configuration. In the embodiment of FIG. 3, the grooves 112 are in the form of ledges to define a stepped configuration or profile in the concave surface 8. In the embodiment of FIG. 4, the grooves 212 have a V-shaped configuration to define a sawtooth profile in the bottom surface.

The grooves 12 shown in the drawing are enlarged for illustrative purposes. Preferably, the grooves comprise micro-grooves or riblets in the dimple bottom surface.

The golf ball shown in FIG. 1 includes a plurality of grooved dimples 110 as well as a plurality of plain circular dimples 4. It will be appreciated to those of ordinary skill in the art that the ball may comprise all grooved dimples. In addition, the dimples may be arranged in a pattern on the golf ball surface to maximize the dimple coverage thereon. Furthermore, grooved dimples of different depths may be provided, and grooved dimples may also be used with non-symmetric dimple depth profiles.

In all of the embodiments, the grooved dimples significantly alters the air flow across the surface of the ball as it travels through the air when struck by a golf club. The altered air flow serves to decrease the drag on the ball, thereby increasing the distance that it will travel.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. A dimple arranged in a spherical surface of a golf ball, comprising an outer edge defining a geometric configuration at the intersection with the spherical surface and a concavity in the ball surface, said concavity having a bottom surface containing a plurality of grooves, said grooves being concentrically arranged relative to the geometric configuration and having edges defining configurations corresponding to the geometric configuration of the dimple outer edge, the depth of said grooves relative to the outer edge increasing from an outermost groove to an innermost groove.

2. A dimple as defined in claim 1, wherein said grooves define a stepped profile for said dimple.

3. A dimple as defined in claim 1, wherein said grooves are equally spaced.

4. A dimple as defined in claim 1, wherein said grooves have a V-shaped configuration, whereby said dimple has a sawtooth profile.

5. A dimple as defined in claim 1, wherein said dimple has a circular configuration.

6. A dimple as defined in claim 1, wherein said dimple has an oval configuration.

7. A golf ball having a spherical surface containing a plurality of dimples, at least one of said dimples comprising an outer edge at the intersection with the spherical surface and a concavity in the ball surface, said concavity having a bottom surface containing a plurality of grooves, said grooves being concentrically arranged relative to the geometry defined at the dimple outer edge and having edges corresponding in configuration to the geometry of the dimple outer edge, the depth of said grooves relative to the outer edge increasing from an outermost groove to an innermost groove.

8. A golf ball as defined in claim 7, wherein said grooves define a stepped profile for said dimple.

9. A golf ball as defined in claim 7, wherein said grooves are equally spaced.

10. A golf ball as defined in claim 7, wherein said grooves have a V-shaped configuration, whereby said dimple has a sawtooth profile.

11. A golf ball as defined in claim 7, wherein said dimple has a circular configuration.

12. A golf ball as defined in claim 7, wherein said dimple has an oval configuration.

* * * * *